US005940940A

United States Patent [19]

Tanikoshi et al.

[11] Patent Number: 5,940,940

[45] Date of Patent: Aug. 24, 1999

[54] BUTTON ATTACHING FASTENER

[75] Inventors: Hirofumi Tanikoshi; Tsukasa Tenjin, both of Toyama-ken, Japan

[73] Assignee: YKK Corporation, Tokyo, Japan

[21] Appl. No.: 09/072,699

[22] Filed: May 6, 1998

[30] Foreign Application Priority Data

May 8, 1997 [JP] Japan ..... 9-154266

[51] Int. Cl.[6] ..... A44B 1/00

[52] U.S. Cl. ..... 24/108; 24/113 MP

[58] Field of Search ..... 24/108, 109, 113 R, 24/113 MD, 114.05, 114.4, 687, 94–96

[56] References Cited

U.S. PATENT DOCUMENTS

| | | | |
|---|---|---|---|
| 1,968,221 | 7/1934 | Reiter | 24/108 X |
| 4,571,780 | 2/1986 | Fukuroi | 24/114.4 X |
| 4,793,029 | 12/1988 | Burke . | |
| 4,928,362 | 5/1990 | Collas et al. . | |
| 4,941,234 | 7/1990 | Watanabe et al. | 24/113 MP |
| 4,967,452 | 11/1990 | Watanabe et al. | 24/113 MP X |
| 5,173,997 | 12/1992 | Takezawa et al. | 24/114.05 X |
| 5,189,762 | 3/1993 | Giancaspro | 24/108 |
| 5,575,043 | 11/1996 | Candotti | 24/108 X |

FOREIGN PATENT DOCUMENTS

| | | |
|---|---|---|
| 0 695-517 | 2/1996 | European Pat. Off. . |
| 2040886 | 1/1971 | France . |
| 206326 | 11/1923 | United Kingdom . |
| 1073355 | 6/1967 | United Kingdom . |

*Primary Examiner*—James R. Brittain
*Assistant Examiner*—Robert J. Sandy
*Attorney, Agent, or Firm*—Hill & Simpson

[57] ABSTRACT

A button attaching fastener consisting of a button cap and an attachment plug. The button cap has centrally in its rear surface a socket, and the attachment plug has on one end a flange fitted in the socket with a clench portion provided along an outer periphery of the socket clenched over the flange through its substantially entire surface. The clench portion has on its outer surface a plurality of rotation-preventing projections extending radially outwardly from the base of the flange. The rotation-preventing projections serve to prevent the fastener from rotating on a piece of fabric, as of clothing, and also to increase the pulling strength of the attachment plug.

13 Claims, 5 Drawing Sheets

BUTTON ATTACHING FASTENER

BACKGROUND OF THE INVENTION

1. Field of the Invention

This invention relates to a fastener for attaching a button or a button-like article to a garment, a bag, etc.

2. Description of the Related Art

A snap button fastener is currently known as disclosed in Japanese Patent Laid-Open Publication No. Sho 61-154505. In this conventional fastener, a button body has in its rear surface a central recess in which a flange of an eye member is embedded, and an outer peripheral projection of the recess is bent over and fused with the peripheral edge of the flange by heating and pressing. In another conventional fastener as exemplified by Japanese Utility Model Publication No. Hei 7-48087, a button body has in its rear surface a central recess to which a socket is adhered, and a flange of an eye member is embedded in the socket and fixedly held by a plurality of peripheral projections of the socket clenched over the peripheral edge of the flange.

In the first-named conventional fastener, since only the peripheral edge of the flange of the eye member is fixed, the pulling strength between the eye member and the button body is inadequate. And since the uncovered area of the flange of the eye member is flat and is located inside the general rear surface of the button body, the button tends to rotate on the fabric piece as of clothing, which would impair its ornamental value if an emblem, design, etc. bearing on the button is directive. Therefore such conventional fastener is not suitable for use on a piece of thin fabric as of a female garment in particular. In the second-named conventional fastener, although the button is hard to rotate on the fabric as the clenched peripheral projections of the socket make the rear surface of the button body project locally along the peripheral edge of the flange, the pulling strength between the eye member and the button body is still inadequate.

SUMMARY OF THE INVENTION

With the foregoing conventional problems in view, it is an object of this invention to provide a button attaching fastener which enables attaching of a button preventing rotation on the fabric and an attachment plug is firmly secured to a button cap.

According to the invention, the above object is accomplished by a button attaching fastener comprising: a button cap having a socket centrally in its rear surface; an attachment plug having on one end a flange fitted in the socket; a clench portion formed along an outer periphery of the socket being clenched over the flange of the attachment plug through its substantially entire surface, and a plurality of rotation-preventing projections formed on an outer surface of the clench portion.

Preferably, the flange has on its inner surface a plurality of recesses corresponding to the rotation-preventing projections so that the rotation-preventing efficiency can be increased.

Further, each of the rotation-preventing projections may has a peak projecting from the rear surface of the button cap so that the rotation-preventing efficiency can be much increased as these projections bite the garment fabric.

In an alternative form, the rotation-preventing projections may extend radially outwardly from a base of the flange of the attachment plug.

In another alternative form, each of the rotation-prevention projections may have a conical shape.

In still another alternative form, the rotation-preventing projections may be arranged as parallel stripes.

In a further alternative form, the rotation-preventing projections are arranged as crossed stripes.

DETAILED DESCRIPTION OF THE PREFERRED EMBODIMENTS

Various embodiments of this invention will now be described in detail with reference to the accompanying drawings.

FIGS. 1 through 7 show a button attaching fastener (hereinafter simply called the fastener) according to a first embodiment of the invention. In use, the fastener is to be joined with a snap member (described below) with a piece of fabric as of a garment sandwiched between them.

Figure 1:
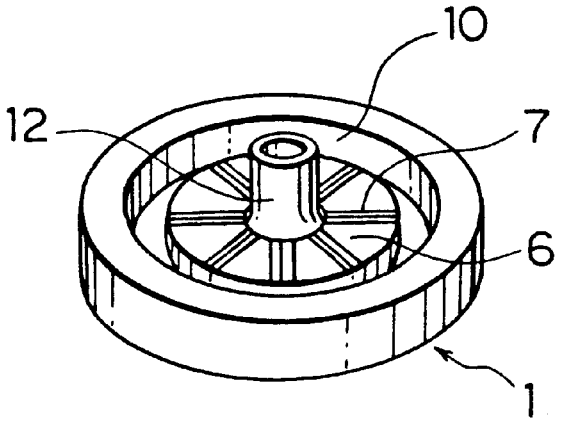
FIG. 1 is a perspective view of a button attaching fastener according to a first embodiment of this invention.
Figure 2:
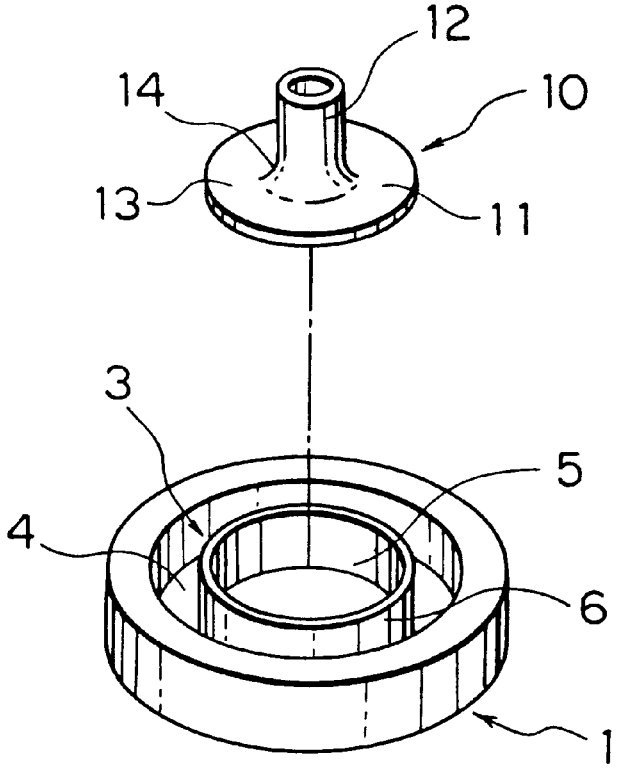
FIG. 2 is an exploded perspective view showing the fastener before having been assembled.
Figure 3:
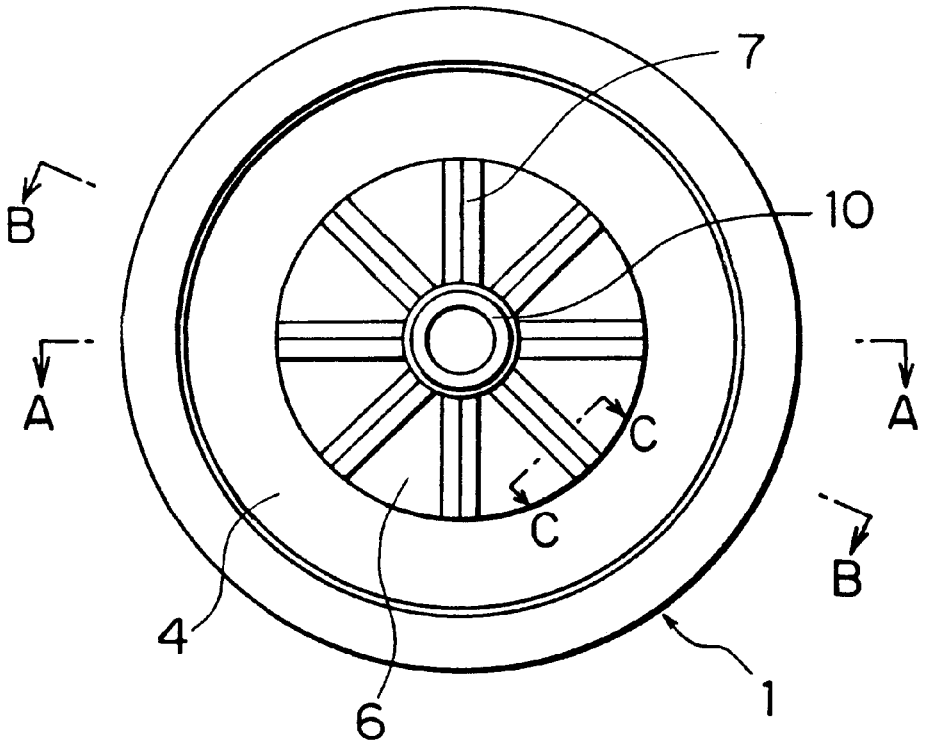
FIG. 3 is a bottom plan view showing the fastener as assembled.
Figure 7:
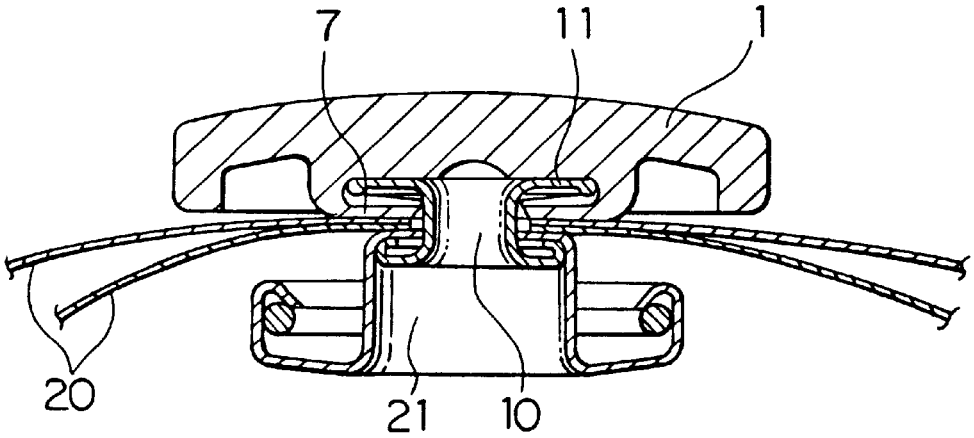
FIG. 7 is a cross-sectional view showing the fastener as having been joined with a snap member with the garment fabric sandwiched between them.

As better shown in FIG. 2, the fastener consists of a button cap (hereinafter simply called the cap) 1 and an attachment plug 10 to be attached to a rear surface of the cap 1. In use, as shown in FIG. 7, a tubular leg 12 of the attaching plug 10 of the fastener is pierced through a piece of fabric 20 as of a garment, a bag, etc., and then the attaching plug 10 is joined with a snap member 21 or a pressure member, such as a fabric attachment fitting, on the rear side of the fabric 20.

The cap 1 is molded of hard or soft thermoplastic synthetic resin, bearing on its front surface an ornament 2 and having centrally in its rear surface an accommodation portion 3 in which one end portion of the attachment plug 10 is to be embedded. The accommodation portion 3 includes an annular recess 4 near its outer periphery and a circular recess 5 located centrally and surrounded by a clench portion 6, which is tubular and projects from the rear surface of the cap 1 as shown in FIG. 2 before having been clenched as described below; the circular recess 5 serves as a socket to which the attachment plug 10 is to be attached.

The attachment plug 10, which is usually called as an eyelet, is made from a thin sheet of metal and has at its lower end a flange 11 flaring outwardly with an upper portion being the tubular leg 12. In use, the leg 12 is joined with the snap member 21 or the fabric attaching fitting with its upper end outwardly expanded by clenching with the fabric 20 sandwiched between the attachment plug 10 and the snap member 21, as shown FIG. 7.

Figure 6:
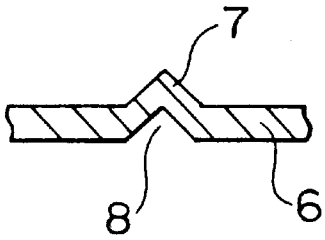
FIG. 6 is an enlarged cross-sectional view taken along line C—C of FIG. 3.

FIGS. 1, 3, 4 and 5 shows the fastener in which the attachment plug 10 is attached to the cap 1 and the clench portion 6 defining the circular recess 5 has a plurality of rotation-preventing projections 7 formed simultaneously with the clenching by a clenching die 22 described below; the rotation-preventing projections 7 serve to prevent the fastener from rotating on the garment fabric 20 when the fastener is attached to the garment fabric 20. In this embodiment, the rotation-preventing projections 7 are eight projections extending radially outwardly of the flange 11 from its base 14 toward its peripheral edge 13. Each of the rotation-preventing projections 7 has a peak slightly projecting from the general rear surface of the cap 1. Simultaneously with the forming of the rotation-preventing projections 7, eight radial recesses 8 corresponding and complementary in shape to these projections 7 are formed on the opposite side as shown in FIG. 6, thus causing an increased rotation-preventing efficiency. Alternatively the peaks of the rotation-preventing projections 7 may not project from the general rear surface of the cap 1; even in such event, the projections 7 can bite into the garment fabric 20 in the presence of the annular recess 4 around the clenched outer periphery in the rear surface of the cap 1 when the fabric 20 is sandwiched between the fastener and the snap member 21, producing an adequate rotation-preventing effect. In another alternative form, each of the rotation-preventing projections 7 may be devoid of the annular recess 8 in the rear surface, an adequate rotation-preventing effect is still produced due to the projections 7 on the surface of the clench portion 6. Since the clench portion 6 is clenched over the flange 11 of the attachment plug 10 so as to conceal its substantially entire surface from the base 14 to the peripheral edge 13, the attachment plug 10 has such an increased pulling strength as not to be removed off the cap 1.

Figure 4:
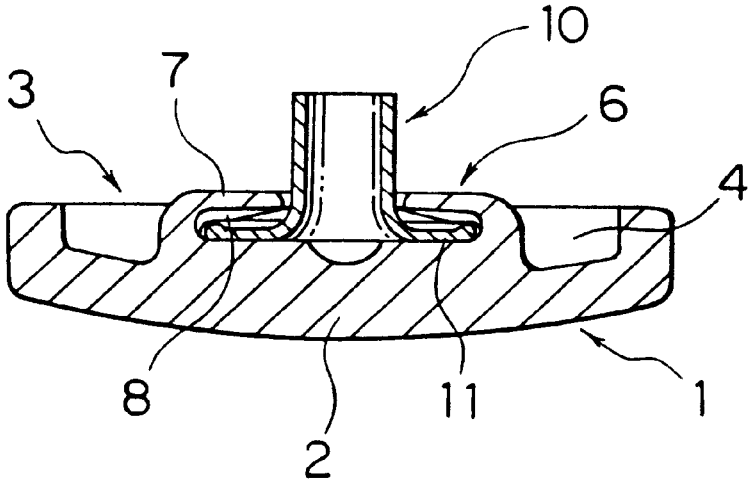
FIG. 4 is a cross-sectional view taken along line A—A of FIG. 3
Figure 5:
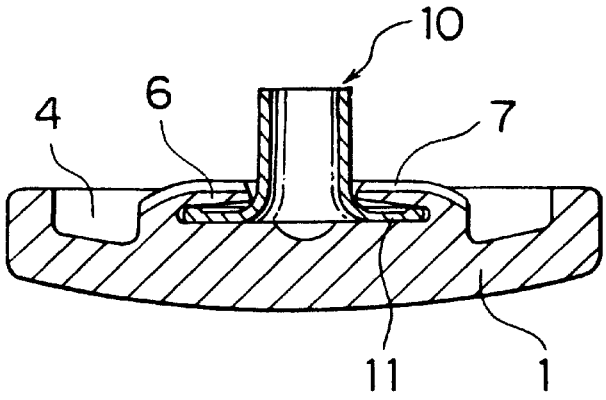
FIG. 5 is a cross-sectional view taken along line B—B of FIG. 3.
Figure 8:
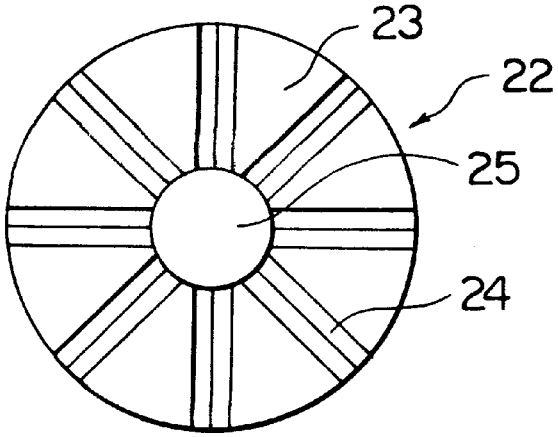
FIG. 8 is a plan view of a clenching die to be used in assembling the fastener.
Figure 9:
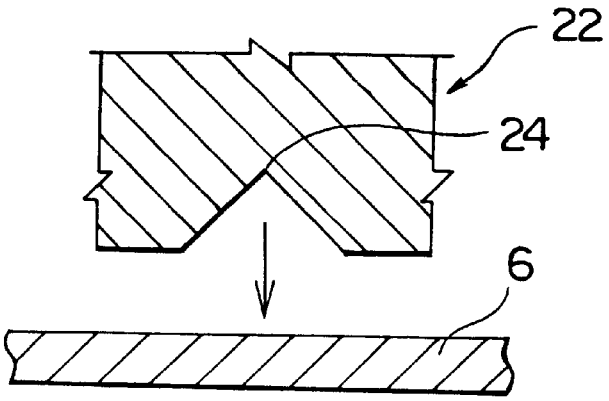
FIG. 9 is a fragmentary cross-sectional view showing a flange of an attachment plug immediately before being clenched using the clenching die during assembling of the fastener.
Figure 10:
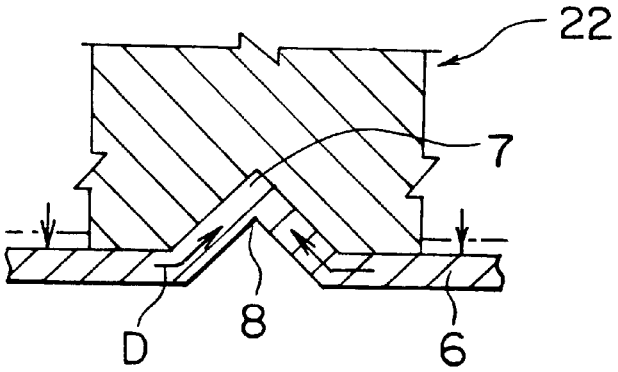
FIG. 10 shows the manner in which a projection (a recess) is formed on the flange of the attachment plug during the clenching.

The method in which the attachment plug 10 is attached to the cap 1 will now be described. Firstly the flange 11 of the attachment plug 10 is fitted in the circular recess 5, which is located centrally in the rear surface of the cap 1, and then the tubular clench portion 6 projecting at the outer periphery of the circular recess 5 is bent radially inwardly by heating and pressing from the upper side using the clenching die 22. Thus the clench portion 6 is clenched so as to conceal the substantially entire surface of the flange 11 of the attachment plug 10 as shown in FIG. 4. As shown in FIG. 8, the clenching die 22 has centrally in a pressure surface 23 an insertion hole 25 for receiving the tubular leg 12 of the attachment plug 10 and around the insertion hole 25 eight radial molding grooves 24. As the clench portion 6 is thus clenched, eight radial projections 7 corresponding to the molding grooves 24 are formed on the outer surface of the clench portion 6. These radial projections 7 serve to prevent the fastener from rotating on the garment fabric 20 when the fastener is attached to the garment fabric 20 as a button, so that the ornament 2 on the button surface would not be deviated off the proper posture and hence become unsightly. Each projection 7 has a peak slightly projecting from the general rear surface of the cap 1 so that the projection 7 bites the garment fabric 20 when attached, thus increasing the rotation-preventing efficiency. During this clenching, several clenching dies 22 different in depth of molding grooves 24 are used one by one in the ascending order of the groove depth as the projections 7 are gradually molded as the clench portion 6 being gradually bent at a temperature lower than the melting point of the thermoplastic synthetic resin of the cap 1 and, at the same time, the recesses 8 having a shape corresponding to that of the projections 7 are formed one on the rear side of each projection 7 by plastic flow of thermoplastic resin in the direction of an arrow D in FIG. 10 so that the clenching operation is done. With the recess 8 on the rear side of each projection 7, the clench portion 6 can be pressed against the garment fabric 20 with increased resiliency, thus producing an increased rotation-preventing effect by resiliently pressing the garment fabric 20.

Figure 11:
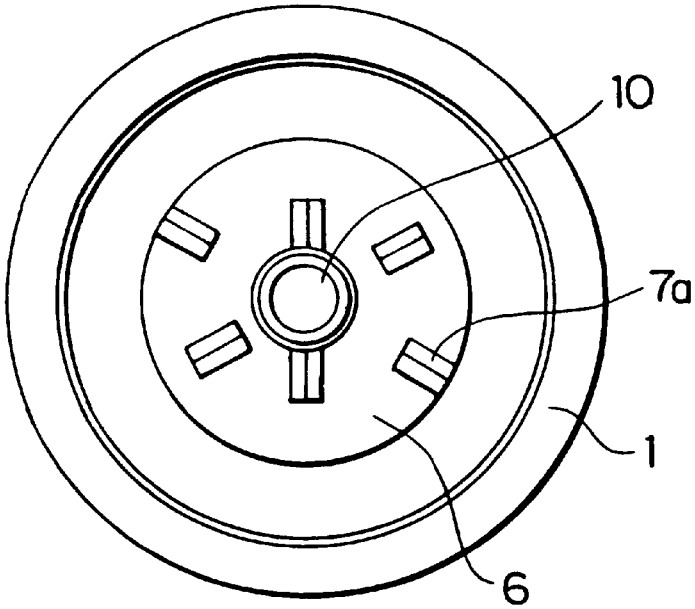
FIG. 11 is a bottom plan view of a button attaching fastener, showing an alternative form of rotation-preventing projections as formed on a clench portion according to a second embodiment of the invention.
Figure 12:
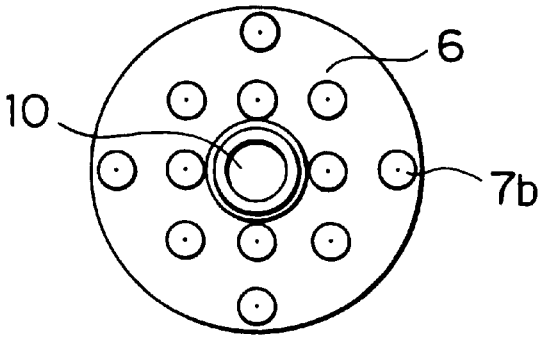
FIG. 12 is a plan view of a clench portion, showing a third embodiment of rotation-preventing projections each having a conical shape.
Figure 13:
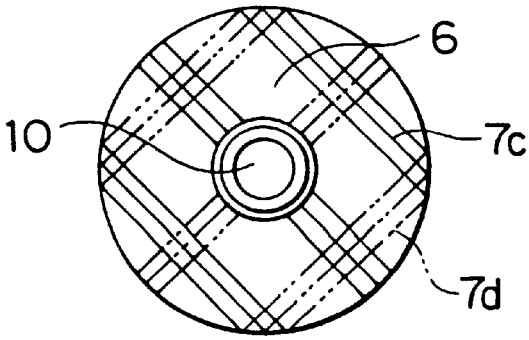
FIG. 13 is a plan view of another clench portion, showing a fourth embodiment of rotation-preventing projections as arranged in parallel or as crossed stripes.

FIGS. 11 through 13 show various embodiments of rotation-preventing projections 7, which are to be formed on the clench portion 6 of the cap 1. Specifically, in the second embodiment of FIG. 11, rotation-preventing projections 7*a* which are different in length and orientation from one another are radially disposed in six directions; the projections 7*a* may be a combination of those having the same length or orientation. In the third embodiment of FIG. 12, a number of conical rotation-preventing projections 7*b* are arranged radially. In the third embodiment of FIG. 13, three straight rotation-preventing projections 7*c* are arranged as parallel stripes as indicated by solid lines instead of being disposed radially. Alternatively three more straight rotation-preventing projections 7*d* may be added to the parallel stripes 7*c*, as indicated by dash-and-two-dot lines, to form crossed stripes.

In each of the second through fourth embodiments, each projection 7*a*, 7*b*, 7*c*, 7*d* may has on its rear side a recess 8 having a shape corresponding to that of the projection 7*a*, 7*b*, 7*c*, 7*d*.

The foregoing rotation-preventing projections 7 formed in the clench portion 6 may have a wide range of selection in arrangement, size, shape, etc. according to the kind of the garment fabric 20 to which the cap 1 is to be attached, the kind of synthetic resin of the cap, etc. More specifically, the presence/absence of the recesses 8 on the rear side of the projections 7, the extent to which the peaks of the projections 7 project from the general rear surface of the cap 1, and even whether they project or not may be suitably determined according to the kind of the garment fabric 20 to which the cap 1 is to be attached, the kind of synthetic resin of the cap 1 and other factors.

According to the first aspect of the invention, since the clench portion 6 is clenched over the flange 11 of the attachment plug 10 fitted in the clench portion 6 of the cap 1 through its substantially entire surface and has on its outer surface a number of rotation-preventing projections 7, the pulling strength between the attachment plug 10 and the cap 1 is adequately high so that the attachment plug 10 is free from removal off the cap 1. And the button can be prevented from rotating on the garment fabric 20 due to the rotation-preventing projections 7 of the clench portion 6 when the button is attached onto the garment fabric 20, so that the button does not become unsightly. With the simple structure that produces the high pulling strength and the rotation-preventing effect, the fastener is particularly useful when attached to a thin garment.

According to the second aspect of the invention, since each of the rotation-preventing projections 7 has on its rear side a corresponding recess 8, the clench portion 6 can have an increased resiliency to press the garment fabric 20 stably, thus increasing the rotation-preventing effect.

According to the third aspect of the invention, since the rotation-preventing projections 7 have peaks projecting from the general rear surface of the cap 1, they can bite the garment fabric 20 when the fastener is attached to the garment fabric 20, thus causing a much increased rotation-preventing effect.

According to the fourth aspect of the invention, since the rotation-preventing projections 7 extend radially of the flange 11 of the attachment plug 10 from its base 14 to its outer peripheral edge 13, the surface of the clench portion 6 of the central recess has an increased resistance to rotation on the garment fabric 20 to realize high rotation-preventing effect.

According to the fifth aspect of the invention, since the rotation-preventing projections 7 have a conical shape, the peaks of the conical projections can bite the garment fabric 20, thus securing an increased rotation-preventing effect.

According to the sixth aspect of the invention, since the rotation-preventing projections 7 are arranged as parallel stripes, the button can be prevented from rotating on the garment fabric 20.

According to the seven aspect of the invention, since the rotation-preventing projections 7 are arranged as crossed stripes, it is possible to obtain an adequate rotation-preventing effect.

What is claimed is:

1. A button attaching fastener comprising:

(a) a button cap having a socket centrally in its rear surface;

(b) an attachment plug having on one end a flange fitted in said socket;

(c) a clench portion formed along an outer periphery of said socket and being clenched over said flange of said attachment plug over substantially an entire surface of said flange; and (d) a plurality of rotation-preventing projections formed on an outer surface of said clench portion.

2. A button attaching fastener according to claim 1, wherein said clench portion has on its inner surface a plurality of recesses corresponding to said rotation-preventing projections.

3. A button attaching fastener according to claim 1 or 2, wherein each of said rotation-preventing projections has a peak projecting from the rear surface of said button cap.

4. A button attaching fastener according to claim 1 or 2, wherein said rotation-preventing projections extend radially outwardly from a base of said flange.

5. A button attaching fastener according to claim 1 or 2, wherein each of said rotation-preventing projections has a conical shape.

6. A button attaching fastener according to claim 1 or 2, wherein said rotation-preventing projections are arranged as parallel stripes.

7. A button attaching fastener according to claim 1 or 2, wherein said rotation-preventing projections are arranged as crossed stripes.

8. A button attaching fastener comprising:

(a) a button cap having a socket centrally in its rear surface;

(b) an attachment plug having on one end a flange fitted in said socket;

(c) a clench portion formed along an outer periphery of said socket and being clenched over said flange of said attachment plug; and (d) a plurality of rotation-preventing projections formed on an outer surface of said clench portion;

said clench portion has on its inner surface a plurality of recesses corresponding to said rotation-preventing projections.

9. A button attaching fastener according to claim 8, wherein each of said rotation-preventing projections has a peak projecting from the rear surface of said button cap.

10. A button attaching fastener according to claim 8, wherein said rotation-preventing projections expand radially outwardly from a base of said flange.

11. A button attaching fastener according to claim 8, wherein each of said rotation-preventing projections has a conical shape.

12. A button attaching fastener according to claim 8, wherein said rotation-preventing projections are arranged as parallel stripes.

13. A button attaching fastener according to claim 8, wherein said rotation-preventing projections are arranged as crossed stripes.

* * * * *